US006206041B1

(12) United States Patent
Selwyn

(10) Patent No.: US 6,206,041 B1
(45) Date of Patent: Mar. 27, 2001

(54) FLUID PRESSURE AMPLIFIER

(76) Inventor: Frederick Philip Selwyn, 3 Efford Park Business Park, Vicarage Road, Bude Cornwall EX 23 8LT (GB)

( * ) Notice: Subject to any disclaimer, the term of this patent is extended or adjusted under 35 U.S.C. 154(b) by 0 days.

(21) Appl. No.: 09/147,088

(22) PCT Filed: Apr. 2, 1997

(86) PCT No.: PCT/GB97/00936

§ 371 Date: Jun. 14, 1999

§ 102(e) Date: Jun. 14, 1999

(87) PCT Pub. No.: WO97/37136

PCT Pub. Date: Oct. 9, 1997

(30) Foreign Application Priority Data

Apr. 2, 1996 (GB) ..... 9606949
Mar. 3, 1997 (GB) ..... 9704381

(51) Int. Cl.[7] ..... F17D 3/00; F04B 17/00
(52) U.S. Cl. ..... 137/624.14; 417/225
(58) Field of Search ..... 417/225, 53; 137/624.14

(56) References Cited

U.S. PATENT DOCUMENTS 2,945,447 7/1960 Yamaguchi et al. .
5,727,529 * 3/1998 Tuckey ..... 123/514

FOREIGN PATENT DOCUMENTS 899 903 12/1953 (DE) .
0 655 557 5/1995 (EP) .
2 589 900 5/1987 (FR) .
6447 5/1913 (GB) .
521 783 5/1940 (GB) .

* cited by examiner

*Primary Examiner*—Charles G. Freay
*Assistant Examiner*—Ehud Gartenberg
(74) *Attorney, Agent, or Firm*—Miles & Stockbridge P.C.; John C. Kerins

(57) ABSTRACT

A fluid pressure amplifier is provided, which includes a pipe for flowing fluid and having an array of holes formed therein through which fluid can flow from within the pipe in use, and resiliently-movable obturator means adjacent the pipe and operatively responsive to fluid inlet pressure in the pipe, in which fluid inlet pressure causes the obturator means to oscillate between conditions which alternately permit and prevent fluid from passing through the holes, whereby the fluid leaving the pipe has a pulsed increased pressure. The amplifier is intended for use especially to increase the pressure of water flowing through a pipe submerged in a river, to provide a pumping action to a higher level.

4 Claims, 3 Drawing Sheets

FLUID PRESSURE AMPLIFIER

This invention relates to a fluid pressure amplifier, especially for increasing the pressure of water flowing in a pipe.

It is known that water can be drawn from a limited and known depth and can be raised by reciprocal pumping action to specifically calculated heights. Water can also be drawn from known depths and elevated by the rotary action of an impeller. Water and other fluids, including air, are known to be substantially incompressible and this forms the basis of much present-day engineering practice, which includes reciprocating and rotary pumps for water and reciprocating and rotary compressors for air. The object of the present invention is to increase the pressure of fluids such as air and water without the use of mechanical or electrical energy. The invention is especially intended to increase the outlet pressure of fluid in a pipe where the inlet pressure is low, for example where the pipe is submerged in a river or where the pipe is connected to a low-pressure fluid source.

According to a first aspect of the invention, a fluid pressure amplifier comprises a pipe for flowing fluid and having an array of holes formed therein through which fluid can flow from within the pipe in use and resiliently-movable obturator means adjacent the pipe and operatively responsive to fluid inlet pressure in the pipe, in which fluid inlet pressure causes the obturator means to oscillate between conditions which alternately permit and prevent fluid from passing through the holes, whereby the fluid leaving the pipe has a pulsed increased pressure.

The obturator means may surround the pipe and may comprise an annular ring resiliently movable in a chamber formed around the pipe, the chamber having an annular fluid outlet which can be sealed by the obturator means, or a sleeve member slidingly movable between positions in which the holes are respectively open and closed.

Where the obturator means comprises a ring, the annular chamber may be defined by a shroud having an obturator sealing surface constituted by a seat formed by profiling the inner surface of the shroud. In the rest or open position the obturator ring may be held in position in a groove or recess provided in the outer wall of the pipe, or by an upstanding rib or collar about the duct. Preferably, the obturator is annular and comprises an elastomeric or resilient material, for example a rubber or a plastics material. Preferably, the shroud is cylindrical, although it may be configured in another shape according to use.

In use, flow restriction means, for example, a nozzle or a non-return valve, may be attached to the outlet end of the pipe, causing back pressure of fluid in the pipe. Fluid within the pipe can pass through the holes into the chamber. With resistance to direct axial flow through the pipe being caused by the flow restriction means, the obturator will be forced by the fluid to move into abutment against the seat in the shroud, the fluid flowing through the pipe being forced to exit through the restriction means at enhanced speed. The flow restriction means may be detachable from or integral with the downstream end of the pipe. Optionally, a non-return valve may be integral with the pipe and provided internally thereof.

Fluid passing through the holes in the pipe in the open condition of the obturator means may be collected and recycled or be ducted to waste.

By varying the density, resilience, shape, dimensions and sections of the material comprising the obturator means, the pressure and velocity of the fluid passing through the outlet of the pipe can be increased or decreased. The shape and nature of the obturator means may be varied and may allow variations in the inlet pressure to be accommodated.

In another embodiment, the obturator means comprises a resilient body carried within a chamber in communication with the holes formed in the pipe, the chamber including a sealing surface against which the resilient body is urged under increased fluid pressure in the chamber. Alternatively, a diaphragm or a valve member may be responsive to increased fluid pressure to adopt a chamber-sealing position against the influence of a biassing force tending to open the valve. The resilience of the body or the biassing influence may be adjustable.

In another aspect, the invention provides a method for amplifying the pressure of fluid flowing through a pipe, the method comprising the steps of alternately permitting and preventing fluid to flow through holes formed in the pipe, to provide a pulsed increase in pressure at the pipe outlet, the fluid acting or a resiliently-movable obturator means to cause oscillation thereof between positions which alternately permit and prevent fluid flow through the holes.

Oscillation of the obturator means is caused by a combination of fluid pressure from behind the obturator means and a zone of reduced pressure created in front thereof to urge the obturator means towards the sealing condition, and the resilience thereof tending to move the obturator means towards the open condition, the speed of oscillation depending on the fluid pressure through the holes and the parameter of the obturator means.

The method of fluid pressure amplification according to the invention has many uses; it can be used for example to raise the temperature of water, it can aerate stale water settlements in ponds or reservoirs; it can cut through solids and it can be used in driving power-generating machinery or for propulsion of craft through water.

Embodiments of the invention will now be described by way of example with reference to the accompanying drawings, in which.

Figure 1:
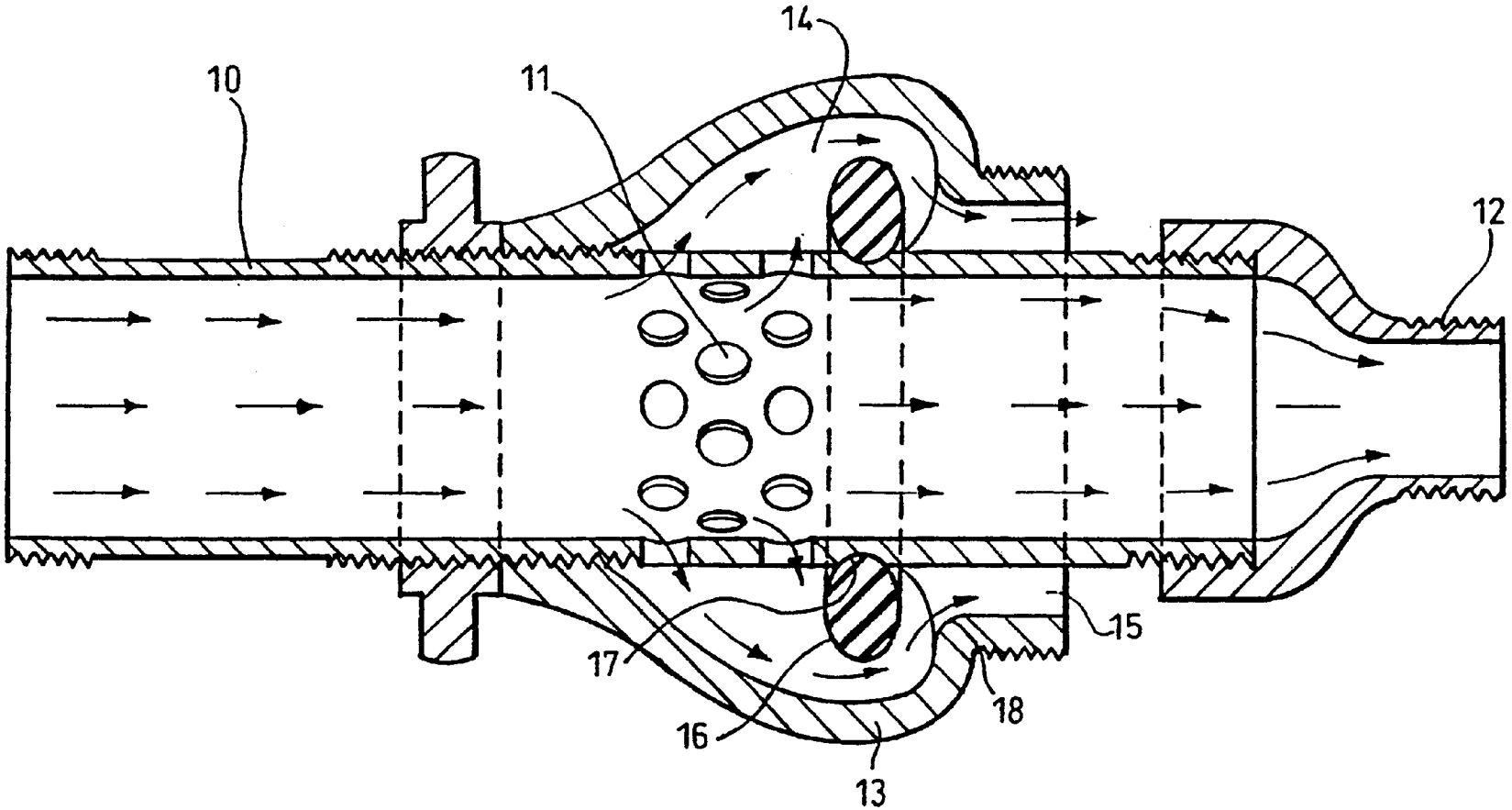
FIG. 1 illustrates a fluid flow amplifier using a ring sited over the outside of an in-line tube.

Referring to FIG. 1, a tube 10 is provided with a plurality of holes 11 and a small aperture outlet nozzle 12. Around the tube 10 is secured a housing 13 defining a chamber 14 which has an annular aperture 15 and is in communication with the holes 11. Within the chamber 14 is provided a rubber, plastics or other resilient material ring 16, which fits snugly onto the outside of the tube 10 and may be located within a shallow groove 17 provided about the exterior of the tube 10. Alternatively, a rib or collar could be provided forward of the ring 16.

The chamber 14 is internally shaped to provide a sealing face or seating 18 for the ring 16. Under relatively low fluid pressures in the tube 10 and in the chamber 14, the gap between the ring 16 and the seating 18 remains open and fluid can thus flow through the annular aperture 15, either to be recycled or allowed to flow to waste.

However, under increased fluid pressure in the tube 10, there will be an increase in pressure in the chamber 14, possibly enhanced by the back-pressure from the nozzle 12, and such pressure will cause the ring 16 to roll or distort in shape towards the seating 18. When the ring 16 abuts against the seating 18, the annular aperture 15 is closed off and the fluid flows forward through the nozzle 12 at increased pressure. The resilience of the ring 16 urges it away from its sealing position and causes rapid or slow pulsing within the chamber 14 and the tube 10. In can thus be seen that the pressure applied to the fluid exiting through the nozzle 12 can be varied by reducing or increasing the size of its aperture and by reducing or increasing the density or resilience of material comprising the ring 16. It will be understood that there are many methods of securing the chamber 14 to the exterior of the tube 10 and it will be equally understood that the internal diameter of the tube 10 can be matched to any desired fluid flow.

The tube 10 can be of any appropriate material commensurate with the requirements of the fluid inflow. The invention can transfer solids in suspension within the fluid.

Figure 2:
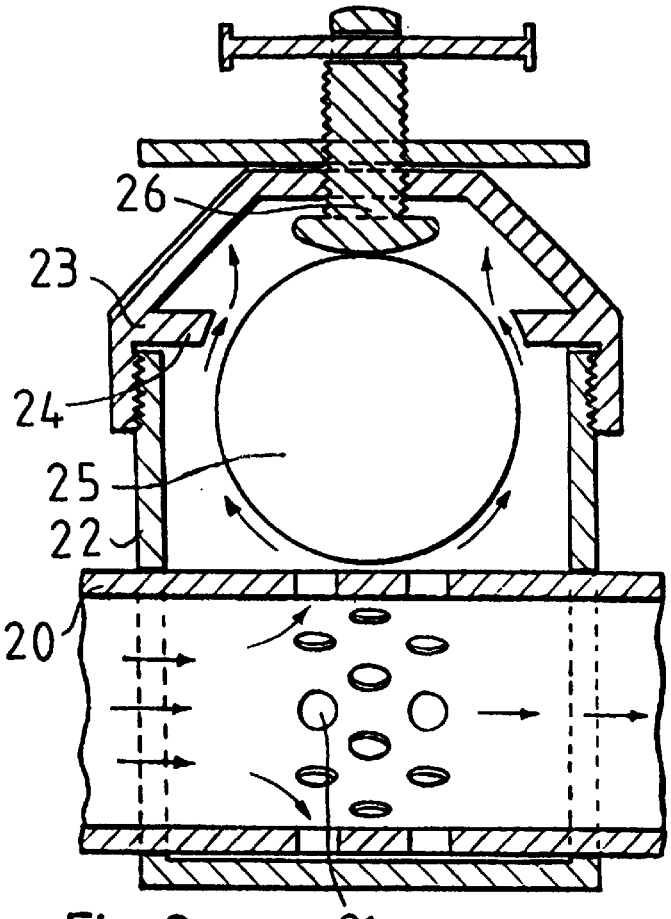
FIG. 2 shows a resilient sphere captive within a chamber disposed about an in-line tube.

Referring now to FIG. 2, tube 20 is provided with a plurality of holes 21 and will have a nozzle at the downstream end (not shown). About the exterior of the tube 20, a chamber is provided consisting of a cylindrical body 22 having a screw-fitted lid member 23 formed with a chamfered internally-projecting flange 24. The chamber contains a resilient sphere 25 sited mid-position in relation to the plurality of holes 21. Above the sphere 25 is provided a screw-threaded clamp 26 which can be tightened down against the sphere 25 or withdrawn from it.

Within the chamber, the flange 24 provides a seating against which the sphere 25 may be forced to abut, as shown by the broken lines, under fluid pressure in the chamber. Fluid flow can occur past the sphere 25 and out from the chamber until the sphere abuts against the seating of the flange 24.

Fluid flow under enhanced pressure will occur in the tube 20 when the sphere 25 seals off flow from the chamber and will take place through the nozzle at the downstream end of the tube 20.

Figure 3:
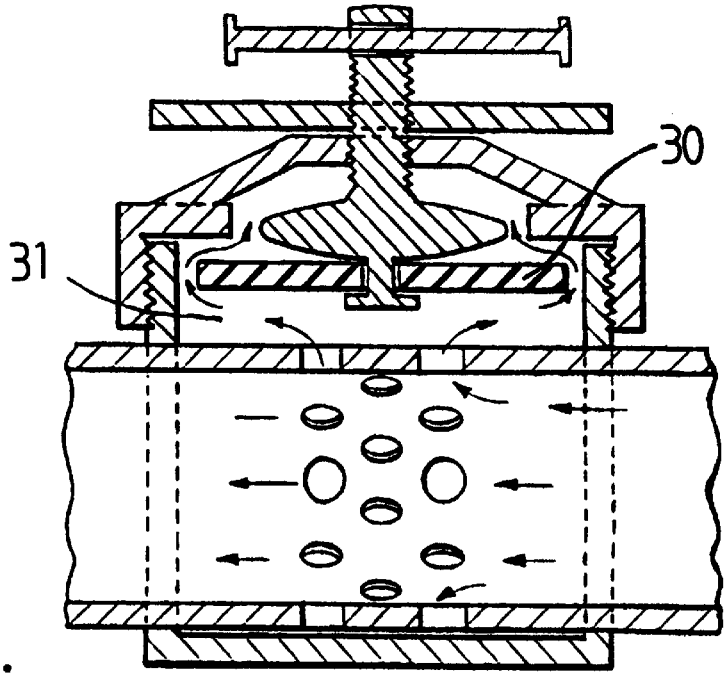
FIG. 3 shows a diaphragm captive within a chamber disposed about an in-line tube.

Referring to FIG. 3, a diaphragm of resilient material 30 has replaced the sphere 25 within a chamber 31 of reduced internal volume. Other features described for FIG. 2 apply, to the apparatus of FIG. 3.

Figure 4:
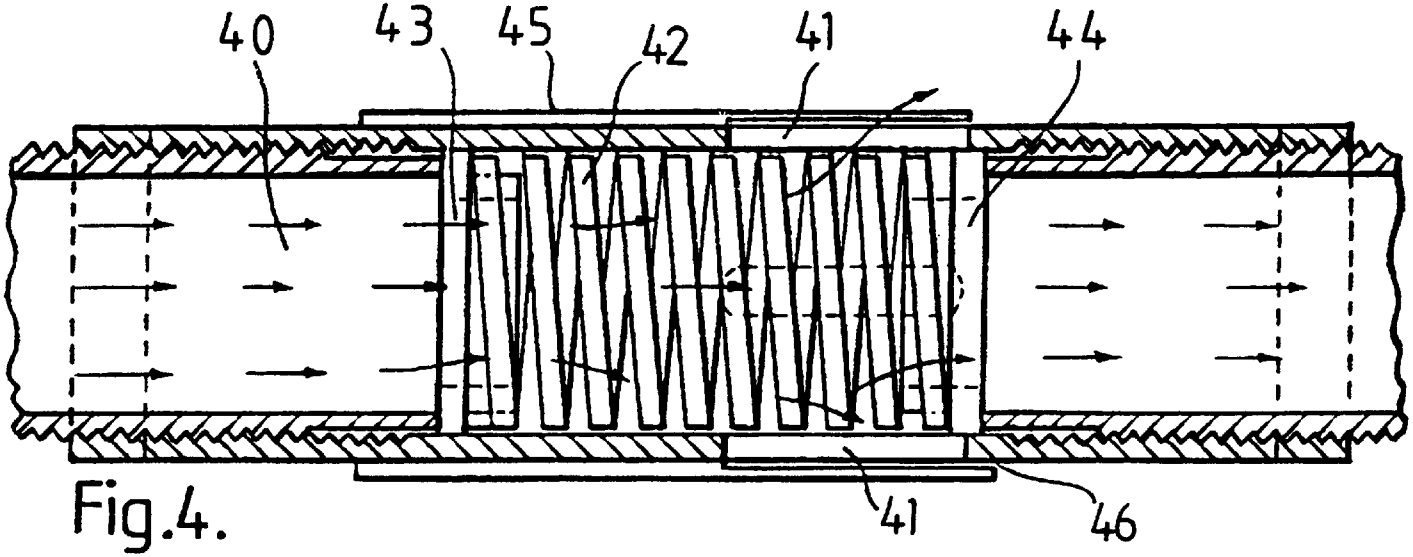
FIG. 4 illustrates the use of a compression spring captive within the tube.

With reference to FIG. 4, there is shown a tube 40 through which is provided a plurality of apertures 41. Within the tube 40 is a compression spring 42 captive between two annular rings 43, 44 the inner marginal portions of which project into the lumen of the tube; the rings are disposed respectively on each side of the apertures 41. Tube 40 is provided with a nozzle at the downstream end and a non-return valve at the upstream end (not shown). A sleeve 45 is disposed around the exterior of the tube 40; the sleeve is operatively connected to the upstream annular ring 43 for axial sliding movement and has an annular aperture 46 of limited sectional area.

Fluid flow through the non-return valve is resisted by the nozzle and exits through the apertures 41 until pressure of the fluid moves the ring 43 forward to cause the sleave 45 to close off the apertures 41. Ring 43 abuts against ring 44 and maintains closure of the apertures 41 for short, repetitive periods throughout the use of the apparatus for what ever use it is applied.

Figure 5:
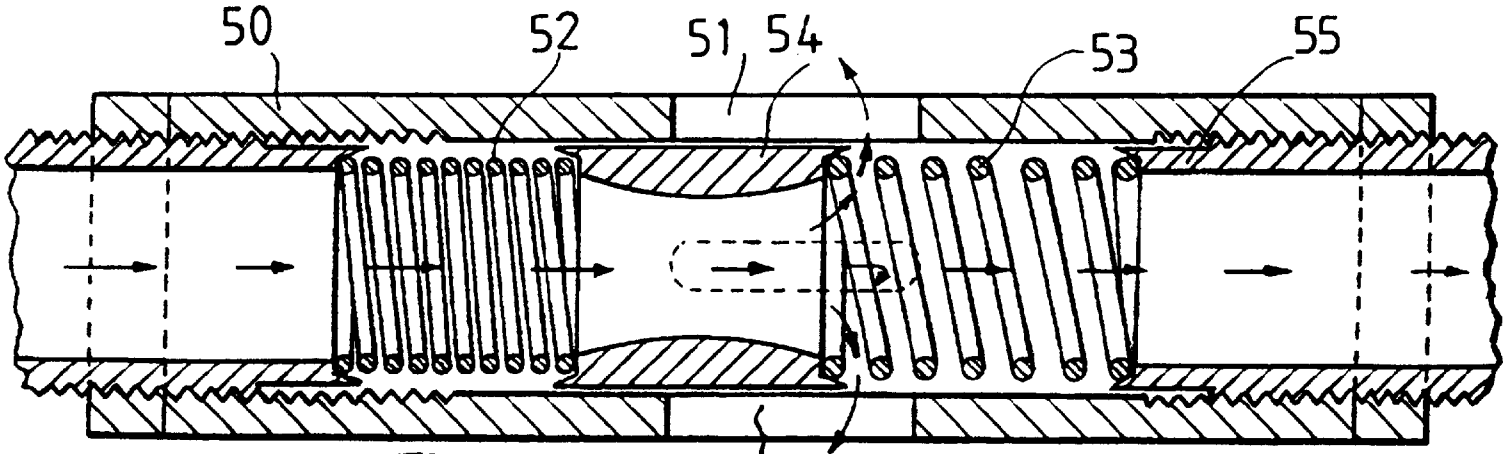
FIG. 5 shows the use of two compression springs captive within the tube to provide fluid flow amplification.

Referring to FIG. 5, two compression springs 52, 53 are provided within a tube 50 through which is provided a plurality of apertures 51. Between the two compression springs 52, 53 is provided a shuttle valve 54 which can move freely within the tube 50.

In this embodiment, spring 52 is forced to compress by the fluid flow along tube 50 and will cause the shuttle valve 54 to close off the apertures 51.

Fluid will then be forced forward through the tube 50 towards the nozzle (not shown) at the downstream end of the tube. The shuttle valve 54 will compress spring 53 which is captive against the tube insert 55.

In the foregoing description, the action of fluid flow through the examples of amplifiers described herein is one of slow or rapid pulsing which in some cases is almost imperceptible, but producing continuity. Enhancement of pressure can be obtained by varying the area of the exit nozzle and by varying the components described herein such as the resilient ring, sphere or diaphragm or the compression resistance of the springs.

In operation, the fluid pressure amplifier can lift water to thirty or forty times the distance of any gravity head or other pressure increase to fluid flowing in the inlet pipe.

What is claimed is:

1. A fluid pressure amplifier comprising a pipe for flowing fluid, a chamber formed around the pipe and having an annular fluid outlet surrounding the pipe, the pipe having an array of holes formed therein through which fluid can flow from within the pipe into the chamber in use, and an obturator ring surrounding the pipe which is resiliently movable in the chamber and operatively responsive to fluid inlet pressure in the pipe such that fluid inlet pressure causes the obturator ring to oscillate between conditions which alternately permit and prevent fluid from passing through the fluid outlet thereby causing a pulsed pressure increase in fluid flowing through the pipe.

2. A fluid pressure amplifier according to claim 1, in which the chamber (14) is defined by a shroud (13) surrounding the pipe and having an obturator sealing surface (18) constituted by a seat formed by profiling the inner surface of the shroud.

3. A fluid pressure amplifier according to claim 2, in which the obturator ring (16) is held in the rest or open position in a groove or recess (17) provided in the outer wall of the pipe.

4. A fluid pressure amplifier according to claim 1, in which said pipe comprises flow restriction means for restricting flow of fluid through the pipe downstream of said array of holes.

* * * * *